US007871307B2

(12) United States Patent
Watanabe et al.

(10) Patent No.: US 7,871,307 B2
(45) Date of Patent: Jan. 18, 2011

(54) FLUID BARREL-POLISHING DEVICE AND POLISHING METHOD

(75) Inventors: Masatomo Watanabe, Kitanagoya (JP); Hiroaki Suesuga, Kitanagoya (JP)

(73) Assignee: Sintokogio, Ltd., Nagoya-shi (JP)

( * ) Notice: Subject to any disclaimer, the term of this patent is extended or adjusted under 35 U.S.C. 154(b) by 0 days.

(21) Appl. No.: 11/884,317

(22) PCT Filed: Feb. 15, 2005

(86) PCT No.: PCT/JP2005/002233

§ 371 (c)(1),
(2), (4) Date: Dec. 4, 2007

(87) PCT Pub. No.: WO2006/087765

PCT Pub. Date: Aug. 24, 2006

(65) Prior Publication Data

US 2008/0166954 A1 Jul. 10, 2008

(51) Int. Cl.
*B24B 1/00* (2006.01)

(52) U.S. Cl. ..... 451/32; 451/35; 451/327; 451/328

(58) Field of Classification Search ..... 451/32, 451/34, 35, 104, 113, 326, 327, 328
See application file for complete search history.

(56) References Cited

U.S. PATENT DOCUMENTS 4,177,608 A 12/1979 Balz ..... 51/163.2
4,850,151 A * 7/1989 Ditscherlein ..... 451/327
4,939,871 A * 7/1990 Ditscherlein ..... 451/327
5,012,620 A * 5/1991 McNeil ..... 451/32
5,211,673 A * 5/1993 Ditscherlein ..... 451/327
6,296,556 B1 * 10/2001 Gegenheimer ..... 451/326
6,379,233 B1 * 4/2002 Kobayashi et al. ..... 451/326
6,733,374 B2 * 5/2004 Gegenheimer et al. ..... 451/326
6,899,605 B1 * 5/2005 Lutz ..... 451/104

(Continued)

FOREIGN PATENT DOCUMENTS

AT 178 UI 4/1995

(Continued)

OTHER PUBLICATIONS

International Search Report in Japanese dated May 24, 2005.

(Continued)

*Primary Examiner*—Eileen P. Morgan
(74) *Attorney, Agent, or Firm*—Sunstein Kann Murphy & Timbers LLP

(57) ABSTRACT

A fluid barrel-polishing device comprises a cylindrical fixed tank (1) and a turntable (2) that is located at the bottom of the tank (1) with a gap (3) that allows it to rotate horizontally, and wherein when workpieces and media are thrown in the fixed tank (1) and the turntable (2) is rotated horizontally, the workpieces and the media circulate and form themselves into a mass (M) and thereby the workpieces are polished, wherein an inner cylinder (4) is rotatably or fixedly placed coaxially on the center of the rotation of the turntable (2) and it allows the workpieces in the mass (M) to be polished with the inside of the mass (M) contacting the wall of the inner cylinder (4) and with its outside contacting the wall of the fixed tank (1).

11 Claims, 3 Drawing Sheets

U.S. PATENT DOCUMENTS

2002/0028630 A1* 3/2002 Kobayashi et al. ..... 451/32

FOREIGN PATENT DOCUMENTS

| | | |
|---|---|---|
| DE | 42 43 380 | 6/1994 |
| JP | 46-35838 | 10/1971 |
| JP | 57-156165 | 9/1982 |
| JP | 58-059762 | 4/1983 |
| JP | 5-329765 | 12/1993 |
| JP | 2003103450 | 4/2003 |

OTHER PUBLICATIONS

US Translation of International Search Report dated May 24, 2005.

European Patent Office, European Supplementary Search Report—Application No. 05719135.5, dated Mar. 31, 2009 (4 pages).

* cited by examiner

FLUID BARREL-POLISHING DEVICE AND POLISHING METHOD

FIELD OF THE INVENTION

The present invention relates to a fluid barrel-polishing device and polishing method that can increase the ability and efficiency for the polishing, increase the productivity by shortening the polishing time, and decrease the running cost by suppressing the wear of media.

DESCRIPTION OF THE PRIOR ART

FIG. 2 is a sectional view of a conventional fluid barrel-polishing device. As shown in FIG. 2, the conventional fluid barrel-polishing device comprises a cylindrical fixed tank 11, a turntable 12 that is located at the bottom of the tank 11, and a gap 13 that allows the turntable to rotate slidably on it.

The horizontal rotation of the turntable 12 imparts a centrifugal force (A) in a direction going from the center of the rotation to the lateral wall of the fixed tank 11 to the workpieces and the media that have been put into the tank 11. The centrifugal force (A) that is imparted to the workpieces and the media is transformed into a climbing force (B) when they reach the lateral wall of the fixed tank 11. The climbing force (B) drives them up to the summit (C) and then they are moved downward by the force of gravity. In this way, the workpieces and the media are formed into the mass (M) that is rotating, and the workpieces are polished by the contact pressures and relative velocities between the workpieces and the media.

However, the mass (M), which is composed of the workpieces and the media, is only moved downward to the center of rotation from the lateral wall of the fixed tank 11 after it is driven to the summit by the climbing force (B), but this creates the following problems.

(1) An "open space" that is an air hole located above the center of rotation is formed.

(2) In the part of the mass (M) that neighbors the open space, the contact pressure (i.e., the polishing ability, and the efficiency for the polishing) is reduced.

The polishing ability of a mechanism of a fluid barrel-polishing device depends on the choice of the media for the workpiece and the object to be polished when the mechanism is for dry polishing, and it depends on the choice of the media and the abrasive compound for use with them when it is for wet polishing. Further, it depends on the ratio of the number of workpieces to that of the media when the mechanism is for dry polishing, and it depends on the ratio of the number of workpieces to the media and the ratio of the quantity of the abrasive compound to the water when the mechanism is for wet polishing. The polishing ability of a barrel-polishing device depends on the contact pressure between the workpieces and the media and on the differential velocity between them. This is the same for a fluid barrel-polishing device.

Considering the construction of the device, the area near the turntable or near the lateral wall of the fixed tank has a strong polishing ability, wherein the contact pressures between the media and the workpieces is strong and the velocity of the flow of the mass is high. In contrast, above the center of rotation, there is an open space as shown in FIG. 2, in which the mass is free from the rotating and there are no media or workpieces.

Japanese Patent Laid-open Publication No. 2003-103450 shows the open space of the mass that is formed above the center of the rotation of the turntable, in FIG. 2.

DISCLOSURE OF THE INVENTION

The present invention was conceived so as to solve the above problems without making any specially significant structural alteration. It comprises an inner cylinder 4 on the center of rotation of the turntable 2 of a polishing device, wherein its centerline is shared with the turntable 2.

By this invention, (1) the inner cylinder 4 prevents the formation of the open space of the mass that would have been formed in a polishing device that is made by a conventional technology, and (2) the mass (M) circulates with its outside contacting the inside wall of the fixed tank 1 and with its inside contacting the wall of the inner cylinder 4.

Accordingly, the pressure of the mass (M) also works on the inner surface of it, and it achieves an effect that increases the contact pressure between the workpieces and media that compose the mass (M) and increases the polishing ability of the device.

Namely, when a conventional polishing device is used, when workpieces and media (additionally, an abrasive compound and water if the device is a wet type) are thrown in a fixed tank and a turntable is rotated, the workpieces and the media (and an abrasive compound and water if the device is a wet type) form themselves into a mass (M). An air hole in the mass (M) is formed above the center of rotation of the turntable (i.e., the center of the fixed tank) and it forms an open space, in which the pressures between the workpieces and the media (and the abrasive compound and the water if the device is wet type) are not worked.

The present invention has an inner cylinder that has an appropriate outer diameter in correspondence with the inner diameter of the fixed tank and in accord with the purpose to process the workpieces. It is located at the same place as the open space that would appear in a conventional polishing device in an appropriate way. Thus, no open space, which would be an air hole in the mass, is formed in it.

Further, (1) the inner cylinder puts pressure on the mass in a direction going from the inside of it to the lateral wall of the fixed tank. Accordingly, it works based on the contact pressures between the workpiece and the medium (and the abrasive compound and the water if the device is a wet type), and increases the polishing ability, and (2) the inner cylinder decreases the radial area in which the mass is fluidized in the fixed tank. Accordingly, the height of the upper surface of the mass is increased, and the upper part of the mass puts pressure on the internal part of it and this pressure also increases the polishing ability.

The above is a mechanism whereby the inner cylinder can increase the polishing ability. Now we discuss the wear of the media.

When a conventional fluid barrel-polishing device is used, the more the polishing ability is increased, the more the wear of the media is increased, and the efficiency for the polishing (i.e., the amount polished of the workpieces divided by the amount the media is worn) is decreased. The polishing of the workpieces wears the media. However, the rubbing between media, i.e., the contact pressure between them and the differences of the relative velocities between them, wears the media far more than the wear caused by the polishing of the workpieces.

The flow velocities of both lateral sides of the mass become lower because of the frictional forces from the walls of the inner cylinder and the fixed tank, as discussed in (1) above.

The flow velocities of the upper part of the mass are very low, because this part is far from the turntable, as discussed in (2) above. Therefore, even though the present invention increases the polishing ability, the wear of the media of the invention is almost the same as that of a conventional technology, which does not increase the polishing ability.

The reason that the ratio of the wear of the media to the polishing of the workpieces does not increase is that the flow velocity of the mass becomes less as a whole because of the effects of (1) and (2) above, and because the inner cylinder is put on the center of the rotation of the turntable. Namely, the wear of the media is decreased because the flow velocity of the mass is less as a whole. The increase in the wear of the media by increasing the pressure that is applied to the mass is compensated for by the decrease in the wear by decreasing its flow velocity.

As shown in the examples below, the polishing of the workpieces was increased by 1.4-2.4 times more than that of the conventional technology that had no inner cylinder. In contrast, the wear of the media was increased by just 1.2-1.4 times more than that of the conventional technology. Accordingly, the efficiency for the polishing was increased by 1.2-1.7 times. Namely, the wear of the media can be decreased in order to polish a certain number of workpieces and the polishing ability can be increased compared to the wear of the media. Therefore, the running cost of the media can be decreased, the time necessary to polish can be decreased, and the productivity can be increased.

In the specification, a workpiece means an object to be polished, and a medium (or media) means an abrasive material that polishes the workpieces by removing the burrs of them, rounding them, glazing them, and removing the scales of them by rubbing the workpieces with it.

Further, any configuration can be adopted for the inside of the inner cylinder 4, which is concentrically put on the center of rotation of the turntable 2. Namely, the inside of it may be solid or hollow, and the hollow part may be reinforced. The shape of it is not restricted to be cylindrical. It may be conical or shaped as an inverted cone.

BRIEF DESCRIPTIONS OF THE DRAWINGS

Figure 4A:
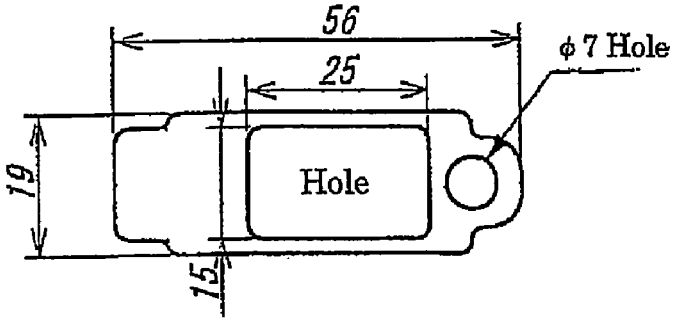

FIG. 4*a* is a plan view of a workpiece (automotive part: a rocker arm) that is used on some examples.

Figure 4B:
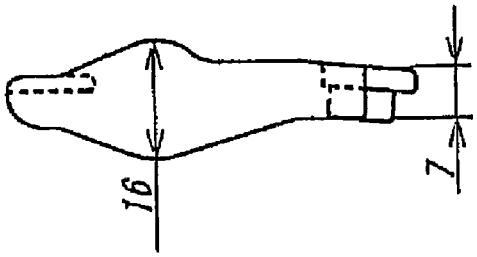

FIG. 4*b* is a elevation view of a workpiece (automotive part: a rocker arm) that is used on some examples.

Figure 4C:
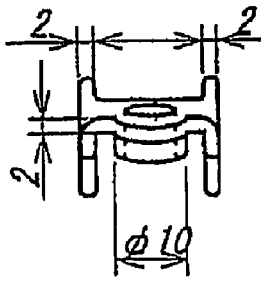

FIG. 4*c* is a lateral view of a workpiece (automotive part: a rocker arm) that is used on some examples.

DETAILED DESCRIPTION OF THE PREFERRED EMBODIMENT

The fluid barrel-polishing device of the invention is described in detail as follows based on the examples and by referring to the drawings.

Figure 1:
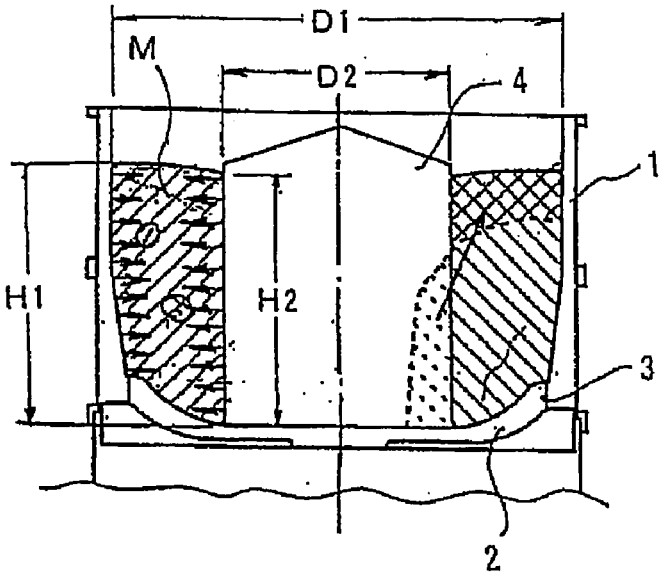
FIG. 1 is a sectional view of a fluid barrel-polishing device according to one embodiment of this invention.

The fluid barrel-polishing device of the invention comprises a cylindrical fixed tank 1, a turntable 2 that is located at the bottom of the tank 1 with a gap 3 that allows the turntable to rotate slideably on it, and an inner cylinder 4 that is concentrically put on the center of rotation of the turntable 2, as FIG. 1 shows.

The horizontal rotation of the turntable 2 imparts a centrifugal force going in a direction from the center of the rotation to the lateral wall of the fixed tank 1 to the workpieces and the media that are put in the fixed tank 1. The centrifugal force that is imparted to the workpieces and the media is transformed into a climbing force when they reach the lateral wall of the fixed tank 1, and the climbing force drives them up.

The inner side of the mass (M), which comprises workpieces and media, contacts the wall of the inner cylinder 4 and the outer side of it contacts the wall of the fixed tank 1. The mass (M) circulates under this condition. Accordingly, the pressure for the mass (M) also works on the inner side of it, and the contact pressure between the workpieces and media, which compose the mass (M), is increased, and thus the polishing ability of the device is increased.

In order to verify the effect of the fluid barrel-polishing device of the invention, hard and soft test pieces were used as the objects to be polished (also referred to as a "workpiece"), and the amount and the rate of the wear of the media were examined, and the amount and the ratio of the polishing of the soft and the hard workpieces respectively in examples 1 and 2, and comparative example 1 were examined.

Then, actual workpieces (automotive parts: a rocker arm) were used as the objects to be polished in order to examine the amount and the rate of the wear of the media, and the amount and the ratio of the polishing of the actual workpieces in examples 3, 4 and 5, and comparative example 2.

These examples show the result of using a wet polishing, in which an abrasive compound and water were added. However, the invention is not restricted to a wet polishing, but it can be applied to a dry polishing.

Figure 3A:
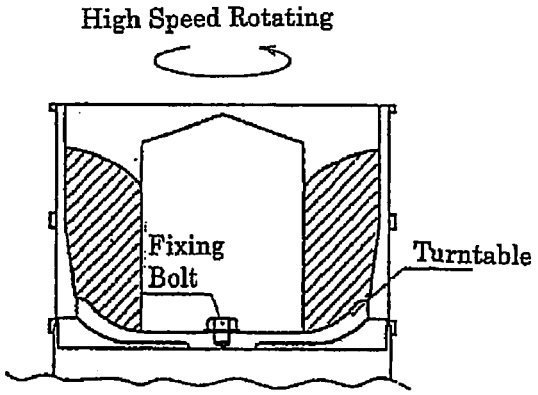
FIG. 3A shows a "fixed rotating" type of an embodiment of the invention, wherein an inner cylinder is put on the center of rotation of a turntable and fixed by fixing bolts so that the inner cylinder is rotated at the same speed as the turntable.

In this embodiment, the ways of attaching the inner cylinder are considered to be three types, i.e., a fixed rotating type, an accompanied rotating type, and a variable rotating type. The fixed rotating type means the type that has an inner cylinder that is put on the center of rotation of a turntable and that is fixed by fixing bolts so that it is rotated at the same speed as the turntable. FIG. 3A shows this type.

Figure 3B:
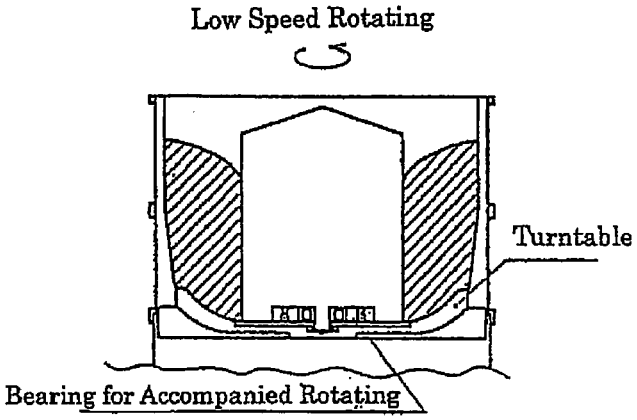
FIG. 3B shows an "accompanied rotating" type of an embodiment of the invention, wherein the inner cylinder is put on the center of rotation of a turntable and supported by bearings so that the inner cylinder is rotated by being driven by the circulating flow of the mass.
Figure 3C:
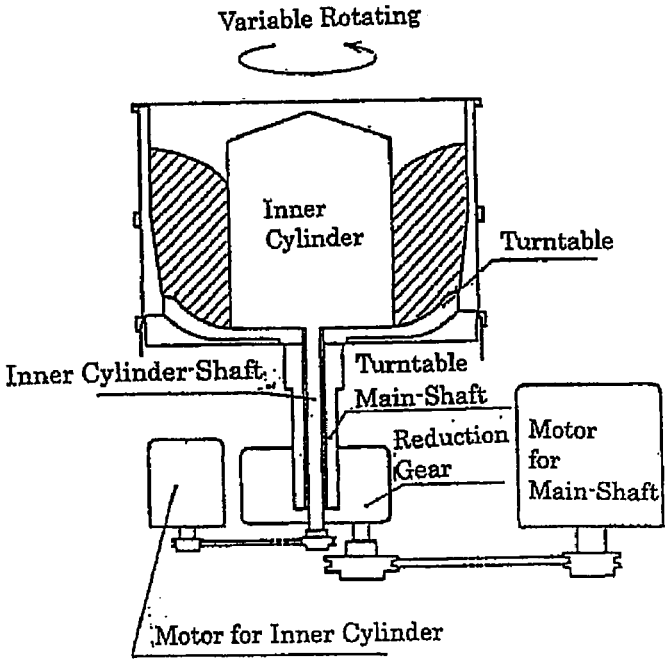
FIG. 3C shows a "variable rotating" type of an embodiment of the invention, wherein the inner cylinder is put on the center of rotation of a turntable and another rotating mechanism is furnished and the appropriate velocity of rotation of the inner cylinder can be set in accordance with the specifications of the workpiece and/or the medium.

The accompanied rotating type means the type that has an inner cylinder that is put on the center of rotation of a turntable and supported by bearings so that it is rotated by being driven by the circulating flow of the mass. FIG. 3B shows this type. The variable rotating type means the type that has an inner cylinder that is put on the center of rotation of a turntable and has another rotating mechanism that controls its velocity at an appropriate value in accordance with the specifications of the workpiece and/or the medium. FIG. 3C shows this type.

Examples 1 and 2

The fluid barrel-polishing devices that are shown in Table 1 were tested. Examples 1 and 2 had an inner cylinder 4 that was put on the center of rotation of a turntable 2, but comparative example 1 had no inner cylinder. The common testing conditions were that hard test pieces made of a material S45C and soft test pieces made of a material A2017 were used as the objects to be polished (hereafter, "workpieces"), a material that had a cone shape with a 20 mm bottom diameter, an abrasive compound, and water, were used as an abrasive material (hereafter, "media"), the velocity of the rotation of the turntable 2 was 250 $min^{-1}$, and the time for polishing was 30 min.

The inner cylinder 4 of examples 1 and 2 had a diameter of 220 mm. In example 1, it was tightly fixed on the center of rotation of the turntable 2, as shown in FIG. 1, and the velocity of its rotation was the same as that of the turntable 2 (250 $min^{-1}$). In example 2, the inner cylinder 4 was not tightly fixed on the center of rotation of the turntable 2, but it was supported by a shaft so that it could be rotated as accompanied rotating, and its velocity rotation was 50 $min^{-1}$. Further, in comparative example 1, was conventional technology, i.e., no inner cylinder was provided.

Under the above test conditions, the workpieces, the media, the abrasive compound, and water were thrown into the respective devices, which corresponded to examples 1 and 2, and comparative example 1, and the turntable was rotated at the velocity of 250 $min^{-1}$. The result of the tests was as shown in Table 2. The machine, the media, and the abrasive compound that were used for the tests were all made by Sintobrator, Ltd.

TABLE 1

| | |
|---|---|
| Testing Machine (Type) | Fluid Barrel-Polishing Device (EVF-04) |
| Testing Machine/Inside Diameter of Fixed Tank | ϕ 440 mm |
| Testing Machine/Inner Volume of Fixed Tank | 40 L |
| Testing Machine/Velocity of Rotation Turntable | 250 $min^{-1}$ |
| Inner cylinder/Outside diameter | ϕ 220 mm (cylindrical) |
| Medium | Resin 87-F20 (cone shaped with a 20 mm bottom diameter) |
| Medium/Quantity | 15 L |
| Abrasive Compound | SCL-3 |
| Abrasive Compound/Quantity | 30 mL |
| Water/Added Quantity | 11.5 L |
| Hard Test Piece/Material, Size, and Quantity | Iron (S45C), ϕ 22 mm × 15 mm h, 3 pcs |
| Soft Test Piece/Material, Size, and Quantity | Aluminum (A2017), ϕ 22 mm × 15 mm h, 3 pcs |

TABLE 2

| | Comparative Example 1 | Example 1 | Example 2 |
|---|---|---|---|
| Inner Cylinder?/Yes or No | No | Yes | Yes |
| Inner Cylinder/Velocity of Rotation ($min^{-1}$) | — | 250 | 50 |
| Medium/Wear (g/0.5 h) | 360 | 383 | 352 |
| Medium/Wear Rate (%/h) | 4.0 | 4.3 | 3.9 |
| Hard Test Piece/Amount Polished (g/0.5 h) | 34 | 66 | 92 |
| Soft Test Piece/Amount Polished (g/0.5 h) | 46 | 80 | 105 |
| Hard Test Piece/Ratio of Polishing | 17 | 31 | 47 |
| Soft Test Piece/Ratio of Polishing | 23 | 37 | 54 |

From the test result shown in Table 2, the following was found concerning (1) the amount and the ratio of the wear of the soft or hard test pieces and (2) the amount of polishing and the ratio of the polishing, depending on whether the inner cylinder was provided and what was its velocity when turned when the soft or the hard test pieces were used.

[1] The Amount and the Ratio of Wear of the Media

The amount and the ratio of wear of the media of examples 1 and 2 were compared to those of comparative example 1. In examples 1 and 2 the inner cylinder 4 was provided on the center of rotation of the turntable 2. In comparative example 1, a conventional technology was used and no inner cylinder was provided. The amount and the ratio of wear of the media of example 1 were more than those of comparative example 1, and those of example 2 were almost the same as those of comparative example 1.

Figure 2:
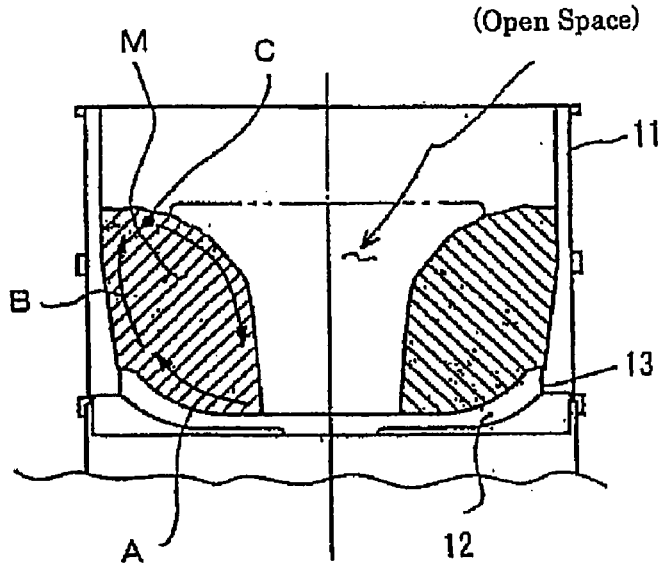
FIG. 2 is a sectional view of a conventional fluid barrel-polishing device.

The reason that the amount and the ratio of wear of the media of example 1 were more than those of comparative example 1, which used a conventional technology, is considered to be that the contact pressure between the media and the object to be polished and that between the media were increased by being provided with the inner cylinder 4 shown in FIG. 1, because no open space of a mass (M) as shown in FIG. 2 was formed, which would have been formed if a conventional fluid barrel-polishing device had been used. It is also considered to be that the velocity of the rotation of the inner cylinder 4 was 250 $mm^{-1}$ (i.e., it was a relatively high velocity), which was the same velocity as that of turntable 2. In the above case, the velocity of the flow of the mass (M) as a whole was less than that when conventional technology was used, wherein no inner cylinder was provided.

The reason that the amount and the ratio of wear of the media of example 2 were almost the same as those of comparative example 1 is considered to be: Even though the contact pressures between the media and the object to be polished and between the media themselves were increased by being provided with the inner cylinder 4 shown in FIG. 1 in a way similar to example 1, since the inner cylinder 4 was provided in such a way that it carried out accompanied rotating with the turntable 2 and the velocity of the rotation was 50 $min^{-1}$, which was less than that of example 1, and the flow velocity of the mass (M) was probably less than that, the amount and the ratio of wear of the media were not more than those of comparative example 1.

The flow velocity of the mass (M) was estimated by the measurement of the velocity of the upper surface of the mass (M), because there was no way to measure it directly.

From the above, it was proven that the amount and the ratio of the wear of the media decrease as the velocity of the rotation of the inner cylinder becomes less than that of the turntable 2, and the less the velocity becomes the more desirable were the conditions that were obtained.

[2] The Amount and the Ratio of Polishing of the Hard and the Soft Test Pieces

The amount and the ratio of the polishing of the hard and the soft test pieces of examples 1 and 2 were both increased to about twice those of comparative example 1, which used a conventional technology. This is because the inner cylinder 4 shown in FIG. 1 was provided as discussed above, and because no open space, which would have been formed in conventional technology (comparative example 1), was formed. Therefore the pressure from the inner cylinder against the mass (M) worked to increase the polishing ability. Thus, it was proven that the inner cylinder of the invention was able to increase the amount and the ratio of the polishing of the test pieces, whether they were hard or soft.

Above all, the amount and the ratio of the polishing in example 2 were both increased to twice above those of the conventional technology shown in comparative example 1. The reason is considered to be that since the velocity of the flow of the mass was less than that of example 1, the workpieces (test pieces) were fluidized in the area that was at the bottom of the polishing tank and near the turntable, where the polishing ability was largest.

In the above, the ratio of the polishing means the value that is given by dividing the amount of the polishing of a test piece per hour by the ratio of the wear of the media. It suggests that the larger the ratio is, the lower the running cost is.

Examples 3, 4, and 5

The fluid barrel-polishing devices that were listed in Table 3 were tested. Examples 3, 4, and 5 had an inner cylinder 4, which was put on the center of rotation of a turntable 2. But comparative example 2 had no inner cylinder. The common testing condition was that actual workpieces, which were rocker arms used as automotive parts and were made of SCM, were used as the objects to be polished (workpieces). Test pieces that were made of the same material as the actual workpieces were used for reference. Fired ceramic that was harder, smaller, and had a larger specific gravity than the one used in examples 1 and 2, an abrasive compound, and water were used as media. The velocity of the rotation of the turntable 2 was 250 $min^{-1}$, and the time for polishing was 30 min. The shape of the workpiece, which is the rocker arm used as an automotive part, is shown in FIG. 4.

TABLE 3

| | |
|---|---|
| Testing Machine (Type) | Fluid Barrel-Polishing Device (EVF-04) |
| Testing Machine/Inside Diameter of Fixed Tank | ϕ 440 mm |
| Testing Machine/Inner Volume of Fixed Tank | 40 L |
| Testing Machine/Velocity of the Rotation of the Turntable | 200 $min^{-1}$ |
| Inner Cylinder/Outside Diameter | ϕ 220 mm (cylindrical), ϕ 260 mm (cylindrical) |
| Medium (Part No.)/Size, Shape | Ceramic (AX-T6 × 5)/triangle pole, 6 mm on a side |
| Medium/Quantity | 15 L |
| Abrasive Compound | SCL-3 |
| Abrasive Compound/Quantity | 30 mL |
| Water/Added Quantity | 11.5 L |
| Workpiece/Name of Article, Material, and Quantity | Rocker Arm for Tappet Roller, S45C, Shown FIG. 4, 2 L |
| Hard Test Piece/Material, Size, and Quantity | S45C, ϕ 22 mm × 15 mm h, 3 pcs |

TABLE 4

| | Comparative Example 2 | Example 3 | Example 4 | Example 5 |
|---|---|---|---|---|
| Inner Cylinder?/Yes or No | No | Yes | Yes | Yes |
| Inner Cylinder/Outside Diameter | — | 220 | 220 | 260 |
| Inner Cylinder/Velocity ($min^{-1}$) of Rotation | — | 200 | 50 | 200 |
| Medium/Wear (g/0.5 h) | 102 | 120 | 142 | 140 |
| Medium/Wear Rate (%/h) | 0.9 | 1.1 | 1.3 | 1.3 |
| Workpiece/Amount Polished (g/0.5 h) | 5 | 7 | 8 | 12 |
| Workpiece/Polishing Efficiency ($\times 10^2$) | 4.9 | 5.8 | 5.6 | 13.5 |
| Hard Test Piece/Amount Polished (mg/0.5 h) | 9.0 | 15.4 | 19.5 | 36.8 |
| Hard Test Piece/Ratio of Polishing | 21 | 28 | 30 | 57 |

As for the inner cylinder 4, in examples 3 and 4 the outside diameter of it was 220 mm, which was the same as that of examples 1 and 2. In example 5, the outside diameter of it was 260 mm, which was larger than that. As for the way of providing it on the turntable 2, in examples 3 and 5 it was put on the center of rotation of the turntable 2 and fixed by fixing bolts and was rotated at the same velocity (200 $min^{-1}$) as that of the turntable 2. In example 4, it was put on the center of rotation of the turntable 2 and was supported so that it was rotated while accompanying the flow of the mass at the velocity of rotation of 50 $min^{-1}$. In comparative example 2, no inner cylinder 4 was provided, which was conventional technology.

Under the above test conditions, the workpieces, the media, the abrasive compound, and water were put into the respective devices that corresponded to the examples and the comparative example, and the turntable was rotated at a velocity of 200 $min^{-1}$. The results of the tests were as shown in Table 4. The machine, the media, and the abrasive compound that were used for the tests were all made by Sintobrator, Ltd.

[1] The Amount and the Ratio of the Wear of the Media

The amount and the ratio of the wear of the media of examples 3, 4, and 5, wherein the inner cylinder 4 was provided on the center of the rotation of the turntable 2, were increased 1.2-1.4 times over those of comparative example 2, wherein a conventional technology was used and no inner cylinder 4 was provided.

While the amount and the ratio of the wear of the media of examples 3 were about 1.2 times over those of comparative example 2, those of examples 4 and 5 were both about 1.4 times over those of comparative example 2. In the above, the outside diameter of the inner cylinder of example 4 was the same as that of example 3 (220 mm) and its velocity of rotation was decreased from 200 $min^{-1}$ to 50 $min^{-1}$, and the outside diameter of example 5 was increased from 220 mm to 260 mm and the velocity of rotation of it was the same as example 3 (200 $mm^{-1}$). A comparison of examples 3 to 5 shows they had the same velocities of rotation and had different outside diameters. But the amount and the ratio of example 5 were 1.2 times more than example 3, wherein its inner cylinder had a larger outside diameter (D2) than did that of example 3. This is because as the outside diameter of the inner cylinder was increased, the width (D1-D2) of the fluidized mass (M), which had an inside diameter of D1, was decreased and the pressure from it against the mass (M) was considered to be increased, and the height (H1 and H2) of the mass (M) also became higher and the pressure from the upper part of the mass (M) was considered to be increased.

[2] The Amount of Polishing and the Efficiency for the Polishing of the Actual Workpieces (Rocker Arms used as Automotive Parts)

The amount of polishing and the efficiency for the polishing of the actual workpieces in examples 3, 4, and 5 were both increased compared to comparative example 2, which was conventional technology. Their amount of polishing were 1.4-2.4 times more than that of comparative example 2, and their efficiency for the polishing was 1.1-2.8 times more than that.

An examination of these results from the viewpoint of the differences of their velocities of rotation, in example 3, wherein the velocity (200 $min^{-1}$) was the same as that of comparative example 2, shows that the amount of polishing was 1.4 times more than that of comparative example 2 and the efficiency for the polishing was 1.2 times more than for that example. In example 4, wherein the velocity (50 $min^{-1}$) was less than for the comparative one, the amount of polishing was 1.6 times more than that for comparative example 2 and the efficiency for the polishing was 1.1 times more than that. The amount of polishing was more in example 4 than in example 3, but the efficiency for the polishing was more in example 3 than in example 4.

By examining the results of example 5, wherein the velocity of rotation of the inner cylinder (200 $min^{-1}$) was the same as that of comparative example 2, and its outside diameter (220 mm) was more than that of the comparative one, one can see that the amount of polishing was 2.4 times more, and the efficiency for polishing was 2.8 times more, than for the comparative one.

From the above result, it is seen that the effects of examples 3 and 4, which showed the differences caused by decreasing the velocity of rotation of the inner cylinder, were compared to those of example 3 and 5, which showed the differences caused by increasing the outside diameter of the inner cylinder. It was proved effective to increase the outside diameter (D2) of the inner cylinder 4, which diameter differed in examples 3 and 5. The same conclusion was reached from the results of the tests that were concurrently carried out for the test pieces used for reference.

From the above, it was proven that if the ratio of the outside diameter (D2) of the inner cylinder 4 to the inside diameter (D1) of the fixed tank 1 is increased and the pressure from the center of the mass (M) is used effectively, the efficiency for the polishing will be increased. Meanwhile, the quality of the workpiece to be polished must be maintained. Especially, scratch marks or marks caused by collisions cannot appear on it. Accordingly, the fluidized area of the mass (M) is determined so that they can be polished under the condition in which the fluidized mass (M) is unimpeded. Therefore, either the maximum outside diameter (D2) of the inner cylinder 4 or the maximum ratio of it to the internal diameter (D1) of the fixed tank 1, which determines the fluidized area of mass (M) and the contact pressure between the media and the workpieces, must be determined by considering the material and the size of the media, and the shape, the size, the material, the quality of the workpieces, etc. In general, an inner cylinder 4 with a large outside diameter (D2) is preferable when the workpieces and media are small, and that with a small outside diameter (D2) is preferable when they are large.

The efficiency for the polishing of workpieces is equivalent to the ratio of the polishing of the test pieces, which was already defined in the previous description of examples 1 and 2 and comparative example 1. Namely, it is given by dividing the amount of the polishing of the work pieces per hour by the ratio of the wear of the media. It suggests that the larger the ratio is, the lower the running cost.

In the above description about examples 1-5, the quantity of the soft test pieces as the objects to be polished (workpieces) of Table 2 was few (3 pieces). The purpose of this test was to confirm that the workpieces were polished without making any scratch marks or marks caused by collisions on the surfaces of them. In the case of polishing the workpieces that are rigorously quality-controlled, it was found that their quantity to be thrown into the fixed tank should decrease. The example shown in Table 2 falls into this case. In contrast, in the case of Table 4, the quantity of the rocker arms of automotive parts (actual workpieces) as the object to be polished (workpieces) was more than that of Table 2, because the purpose of this test was to evaluate the efficiency for polishing certain hard workpieces.

The contact pressures on the workpieces were varied in each case depending on the media, which are listed in Table 5. Namely, the contact pressure of the firing media that were used as the examples in Table 4 (examples 3-5, and comparative example 2) was greater than that of the synthetic resin media that were used as the examples in Table 2 (examples 1 and 2, and comparative example 1).

TABLE 5

| | Table 2 (examples 1 and 2, comparative example 1) | Table 4 (examples 3-5, comparative example 2) |
|---|---|---|
| Material | Synthetic Resin Media | Firing Media |
| Base | Synthetic Resin | Ceramic |
| Shape (size) | Cone (ϕ 20 mm) | Triangle Pole (Δ 6 mm × t 5 mm) |
| Bulk Density (kg/L) | 1.1 | 1.5 |

According to the result shown in Table 2, the amount and the ratio of the wear of the media had no significant differences between examples 1 and 2. In comparative example 1, the differences were associated with "whether the inner cylinder was provided." Further, they had no significant differences between examples 1 and 2. The differences were associated with "what was the velocity of rotation of the inner cylinder."

The reason is considered to be that when the inner cylinder 4 was provided, (1) the rate of the increase of the wear of the media by increasing the pressure against the mass (M), and (2) the rate of the decrease of the wear of the media by decreasing the velocity of the fluidized media, cancelled each other.

In contrast, according to the result shown in Table 4, which was different from that in Table 2, there was a significant difference between examples 3, 4 and 5, and comparative example 2. The differences were associated with "whether the inner cylinder 4 was provided." Further, there were significant differences between examples 3 and 4. The differences were associated with "what was the velocity of rotation of the inner cylinder."

The reason is considered to be that the contact pressures between the media and the workpieces and between the media themselves were increased, because the medium was hard, since the base of it was ceramic, and further, its resistance to friction was great. It is also considered that the contact pressures of the workpieces in relation to the entire mass (M) were distributed equally, because the quantity of the hard workpieces (i.e., rocker arms used as automotive parts) was 2 L (this quantity was above that in Table 2), and so the workpieces did not stay near the bottom of the fixed tank 1 (i.e., near the turntable), but were fluidized in every region of the mass (M), and polished.

To make the comparison between the data in Tables 2 and 4 clearer, Table 6 was prepared to show the data that correspond to the figures if each item of the comparative data were to be converted to 100 for reference. Each item of the data was obtained when no inner cylinder was provided (i.e., comparative examples 1 and 2).

TABLE 6

(The Conversion Table of Table 2)

| | Comparative Example 1 | Example 1 | Example 2 |
|---|---|---|---|
| Inner Cylinder?/Yes or No | No | Yes | Yes |
| Inner Cylinder/Outside Diameter | — | 220 | 220 |
| Inner Cylinder/Velocity of Rotation | — | 250 | 50 |
| Medium/Wear | 100 | 106 | 98 |
| Medium/Rate of Wear | 100 | 108 | 98 |
| Hard Test Piece/Amount Polished | 100 | 194 | 271 |
| Soft Test Piece/Amount Polished | 100 | 174 | 228 |
| Hard Test Piece/Ratio of Polishing | 100 | 182 | 276 |
| Soft Test Piece/Ratio of Polishing | 100 | 161 | 235 |

(The Conversion Table of Table 4)

| | Comparative Example 2 | Example 3 | Example 4 | Example 5 |
|---|---|---|---|---|
| Inner Cylinder?/Yes or No | No | Yes | Yes | Yes |
| Inner Cylinder/Outside Diameter | — | 220 | 220 | 260 |
| Inner Cylinder/Velocity of Rotation | — | 200 | 50 | 200 |
| Medium/Wear | 100 | 118 | 139 | 137 |
| Medium/Rate of Wear | 100 | 122 | 144 | 144 |
| Workpiece/Amount Polished | 100 | 140 | 160 | 240 |
| Test Piece/Amount Polished | 100 | 171 | 217 | 409 |
| Workpiece/Polishing Efficiency | 100 | 118 | 114 | 276 |
| Test Piece/Ratio of Polishing | 100 | 133 | 143 | 271 |

The invention claimed is:

1. A fluid barrel-polishing device comprising: a cylindrical fixed tank (1) and a turntable (2) that is located at the bottom of the tank (1) with a gap (3), wherein the gap allows the turntable to rotate horizontally by a first rotating mechanism; the turntable includes an inner, rotatable cylinder (4) that is rotatably placed coaxially on the center of the rotation of the turntable (2) the inner cylinder being rotated by a rotating means, and wherein workpieces and media are thrown in the fixed tank (1) and the turntable (2) is rotated horizontally by said first mechanism and the inner cylinder is rotated relative to the turntable by said rotating means, the workpieces and the media circulating and forming themselves into a mass (M) and thereby the workpieces being polished.

2. The fluid barrel-polishing device according to claim 1, wherein a width of an outside diameter of the inner cylinder (4) is 50-60% of a width of an inside diameter of the fixed tank (1), wherein the workpieces and media are to be thrown in a space between an outside of the inner cylinder (4) and an inside of the fixed tank (1) so that a height of the mass is 50-70% of a height of a wall of the fixed tank (1) when the turntable is not rotated and wherein the height (H2) of a part of the mass (M) that will contact the wall of the inner cylinder (4) will be more than ½ of the height (H1) of the highest part of the mass (M) when the turntable is rotated.

3. The fluid barrel-polishing device according to claim 1, wherein the mass (M) contact an outer wall of the inner cylinder, the inner cylinder increasing the contact pressure between the workpieces and the media, thereby increasing the polishing ability of the device.

4. The fluid barrel-polishing device according to claim 1, wherein the inner cylinder prevents the mass (M) from forming an open space at the center of rotation as the turntable is rotated.

5. The fluid barrel-polishing device according to claim 1, wherein rotation of the turntable fluidizes the mass of workpieces, the inner cylinder increasing the inside diameter of the radial area in which the mass of workpieces is fluidized.

6. A fluid barrel polishing device according to claim 1, wherein the rotating means is the circulating flow of the mass.

7. A fluid barrel polishing device according to claim 1, wherein the rotating means is a second rotating mechanism.

8. A method for polishing workpieces using a fluid barrel-polishing device comprising a cylindrical fixed tank (1) and a turntable (2) that is located at the bottom of the tank (1),the barrel-polishing device having a gap (3) between the turntable and the bottom of the tank that allows the turntable to rotate horizontally by a first rotating mechanism, and an inner cylinder (4) that is rotatably placed coaxially on the center of the rotation of the turntable (2) and is rotatable by a rotating means relative to the turntable during treatment of workpieces, and wherein the workpieces and media are thrown in the fixed tank (1) and the turntable (2) is rotated horizontally, the workpieces and the media circulating and forming themselves into a mass (M) and thereby the workpieces being polished, comprising:

throwing the workpieces and the media in a space between an outside of the inner cylinder(4) and an inside of the fixed tank (1); and rotating the turntable (2) with said rotating mechanism and rotating the inner cylinder relative to the turntable by said rotating means while an inside of the mass (M) contacts a wall of the inner cylinder (4), and while an outside of the mass (M) contacts a wall of the fixed tank (1).

9. A method according to claim 8, wherein the rotating means is the circulating flow of the mass.

10. A method according to claim 8, wherein the rotating means is a second rotating mechanism.

11. A fluid barrel-polishing device comprising:

a cylindrical fixed tank;

a turntable located at the bottom of the tank with a gap that allows it to rotate horizontally, and wherein workpieces and media are thrown in the fixed tank and the turntable is rotated horizontally, the workpieces and the media circulating and forming themselves into a mass and thereby the workpieces being polished;

an inner cylinder rotatably placed coaxially on the center of the rotation of the turntable, wherein the inner cylinder is rotatable relative to the turntable;

a first rotating mechanism rotating the turntable; and a second rotating mechanism rotating the inner cylinder, the second rotating mechanism configured to rotate the inner cylinder relative to the turntable.

* * * * *